United States Patent [19]

Jenkins

[11] Patent Number: 4,799,618

[45] Date of Patent: Jan. 24, 1989

[54] BIFOLDED MAILER WITH INSERT

[75] Inventor: Richard A. Jenkins, Wheeling, Ill.

[73] Assignee: Moore Business Forms, Inc., Grand Island, N.Y.

[21] Appl. No.: 911,412

[22] Filed: Sep. 25, 1986

[51] Int. Cl.[4] ..... B45D 27/04; B45D 27/34

[52] U.S. Cl. ..... 229/92.3; 206/610; 206/622; 229/71

[58] Field of Search ..... 229/92.1, 92.3, 73, 229/71; 206/622, 610

[56] References Cited

U.S. PATENT DOCUMENTS

| | | | |
|---|---|---|---|
| 826,492 | 7/1906 | Dewes . | |
| 1,000,466 | 8/1911 | Watson . | |
| 1,054,018 | 2/1913 | Mitchell . | |
| 1,147,925 | 7/1915 | Chambers . | |
| 1,307,421 | 6/1919 | Schramm | 229/92.3 |
| 1,708,574 | 4/1929 | Hazen . | |
| 1,794,223 | 2/1931 | Zabek . | |
| 1,874,796 | 8/1932 | Palm . | |
| 2,152,135 | 3/1939 | Case et al. | 229/92.1 |
| 2,298,601 | 10/1942 | Tremblett | 229/92.3 |
| 2,302,455 | 11/1942 | Mattson . | |
| 2,350,100 | 5/1944 | Deutshmeister | 229/73 |
| 2,549,199 | 4/1951 | Hodska . | |
| 2,927,723 | 3/1960 | Johnson | 229/73 |
| 2,985,464 | 5/1961 | McFarland . | |
| 3,113,716 | 12/1963 | Howard | 229/73 |
| 3,214,029 | 10/1965 | Andrews et al. | 206/622 |
| 3,523,638 | 8/1970 | Moonan . | |
| 3,863,835 | 2/1975 | Gendron | 229/92.3 |
| 3,951,332 | 4/1976 | Torbeck | 206/622 |
| 3,982,689 | 9/1976 | Retrum . | |

*Primary Examiner*—Stephen P. Garbe

*Attorney, Agent, or Firm*—Cushman, Darby & Cushman

[57] ABSTRACT

A bifolded mailer is provided with head and foot panels which are individually shorter than its middle panel but collectively longer than its middle panel. The middle panel is provided with a window flap which remains joined along its lower margin. For variably printing the mailer on one face, the window flap is first folded down so that its outer face is exposed on the inner face of the mailer. After variable printing is applied, the form is processed foot first, in the source of which the window flap is folded back up and patched in place, the head panel is folded up and an insert body is deposited in the resulting trough, the foot panel is folded down, and adhesive bands, which have been applied to various marginal regions of the mailer panels, are activated, for instance by heated platens, creating seals at the left and right ends and in the lap between the head and foot on the outside rear of the mailer. Opening the mailer is accomplished by tearing off marginal strips at the ends, and by pulling across another tear strip located in an external panel.

26 Claims, 2 Drawing Sheets

BIFOLDED MAILER WITH INSERT

BACKGROUND OF THE INVENTION

In the field of business forms, the bifolded mailer is a popular item. In general, a bifolded mailer at its simplest comprises a sheet with two longitudinally spaced, parallel transverse folds in the same direction dividing the sheet into a head panel, a middle panel and a foot panel. With the sheet folded on the fold lines, the mailer is fastened closed, thereby enclosing a communication printed or otherwise applied on one face of the sheet. If the item is to be delivered by mail, the other face of one of the panels may be provided with the name and postal address of the intended recipient, statement of postal class, franking information, a return address, a stamp and/or the like.

On more elaborate conventional bifold mailers, the folded sheet is held closed by a pattern of adhesive applied to various perimetrical margins of the panels, which serve to maintain the confidentiality of the communication included on the obscured surfaces of the document until the mailer is opened up. Opening is facilitated by placement of perforation lines which e.g. allow one or more marginal strips to be torn off in order to gain visual access to the surfaces that were obscured.

It is considered to be a valuable feature of business forms, that all variable information can be applied on one face, especially in one pass, on the form stock, regardless of whether the pre-applied relatively non-varying printing is provided on one or both faces of the form stock, and regardless of whether the form stock is provided by the form manufacturer to the business user as a web of indeterminate length or as a stack of cut sheets.

A very convenient conventional way of accomplishing this objective, is to provide one panel of the mailer stock with a window aperture which, in the course of folding and sealing the mailer, comes to expose the intended recipient's name and postal address as variably printed on the opposite face of another panel of the mailer stock.

Often, the business user of such form stock would like to include as an enclosure of a bifolded mailer, a sheet, check, booklet, card, return envelope or the like, having a size that is at least slightly shorter and narrower than the internal size of the bifolded mailer.

The conventional windowed, perforated, adhered margin, bifolded mailer presents two problems to anyone who would wish to enclose such an enclosure sheet or the like within the mailer. First, unless the enclosure is relatively small or odd-shaped and held against lateral movement within the enclosed space, it is almost certain to obscure the name and postal address of the intended recipient, making the mailer difficult or impossible to deliver. Second, unless the enclosure is relatively small and held so as to have a particular juxtaposition relative to the perforated marginal tear strip or tear strips that the recipient will tear-off for gaining access to the communication within the mailer, the user is very likely to also tear off a marginal part of the enclosure.

Further, conventional bifolded mailers are often difficult to reliably stuff with enclosures using available automated machinery.

SUMMARY OF THE INVENTION

A bifolded mailer is provided with head and foot panels which are individually shorter than its middle panel but collectively longer than its middle panel. The middle panel is provided with a window flap which remains joined along its lower margin. For variably printing the mailer on one face, the window flap is first folded down so that its outer face is exposed on the inner face of the mailer. After variable printing is applied, the form is processed foot first, in the course of which the window flap is folded back up and patched in place, the head panel is folded up and an insert body is deposited in the resulting trough, the foot panel is folded down, and adhesive bands, which have been applied to various marginal regions of the mailer panels, are activated, for instance by heated platens, creating seals at the left and right ends and in the lap between the head and foot on the outside rear of the mailer. Opening the mailer is accomplished by tearing off marginal strips at the ends, and by pulling across another tear strip located in an external panel.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
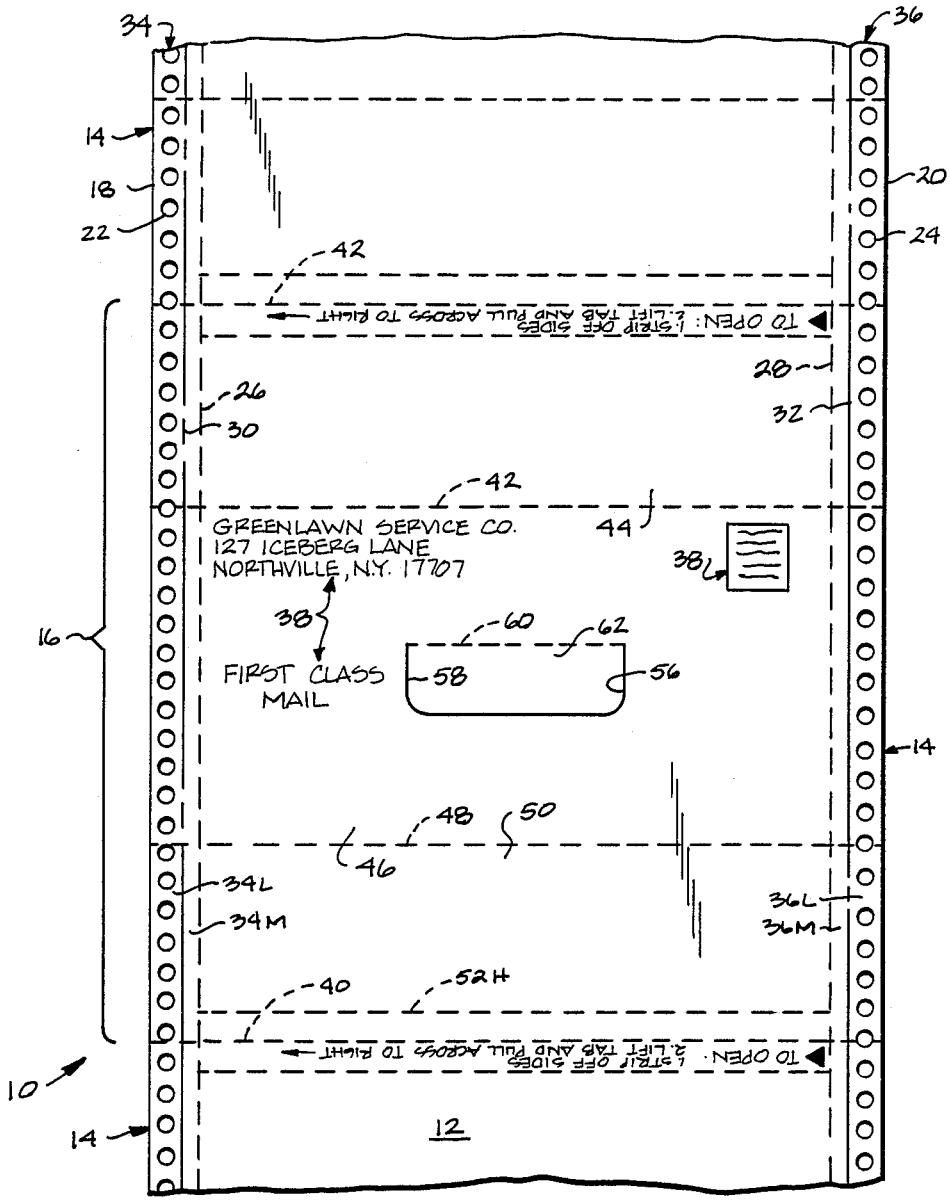
FIG. 1 is a fragmentary plan view of the outer face of a web of business forms embodying principles of the present invention.

In FIG. 1, the outer face 12 of a web 10 of bifolded mailer business form stock is illustrated. The web 10 is of indeterminate length; a portion 14 of the web which will later become one complete specimen of the form is embraced by the bracket 16. Fragments of preceding and succeeding forms are also illustrated in this Figure.

The web 10 may be made of usual paper conventionally used in the manufacture of mailers. This web 10 is shown having opposite side edges 18, 20 each spacedly bordered, in the preferred embodiment, by a respective longitudinal row of drive sprocket holes 22, 24. More medially of the web, adjacent the respective rows of holes 22, 24, the web 10 is shown provided with respective longitudinally running perforation lines 26, 28. The chain dot imaginary longitudinal lines 30, 32 shown located between the respective rows of holes 22, 24 and the respective perforation lines 26, 28 divide the respective end marginal strips 34, 36 into more lateral portions 34L, 36L which may be (but need not be) cut off at a later stage to give the product a neater look, and more medial portions 34M, 36M which will remain with the product, as tear-to-open strips, as the mailer travels through the mail to the intended recipient.

The web 10 is shown further having relatively non-varying information 38 pre-printed on the outer face 12 of the series of forms, by the forms stock manufacturer.

The web 10 is divided into portions 14 that will later become individual mailers, by transverse perforation lines 40. Between these transverse perforation lines, the web 10 is shown provided with a number of additional features including an imaginary transverse fold line 42 on which a mailer subsequently will be folded to define a foot panel 44 and a middle panel 46 thereof, and a transverse fold line 48 on which the mailer subsequently will be folded to define a head panel 50. Adjacent to but spaced longitudinally of the portion 14 from the perforation lines 40 of its top and bottom edges, the head and foot panels 44, 50 are shown provided with transverse perforation lines 52H, 52F for defining between them (after the form is folded and closed), a two-ply transverse tear strip 54 having one edge solely in each of these two panels. The tear strip 54 need not be provided at this site. For instance, it could be provided solely in the middle panel, e.g. with one of its perforation lines coincident with the fold line 48. It could, in the alternative, be similarly formed in either the head panel 50 or the foot panel 44. And it need not be contiguous with a fold line which divides any two of the panels, but may be located with some longitudinal spacing along the respective panel from the respective fold line. The middle panel 46 is shown provided generally medially and longitudinally centrally thereof with a flip window 56 of generally rectangular outline, defined on three sides by a die cut line 58 and on its fourth side, by a perforation line 60, about which the three-sided flap 62 thereby defined can be folded inwards at an intermediate stage in manufacture of the form stock.

Figure 2:
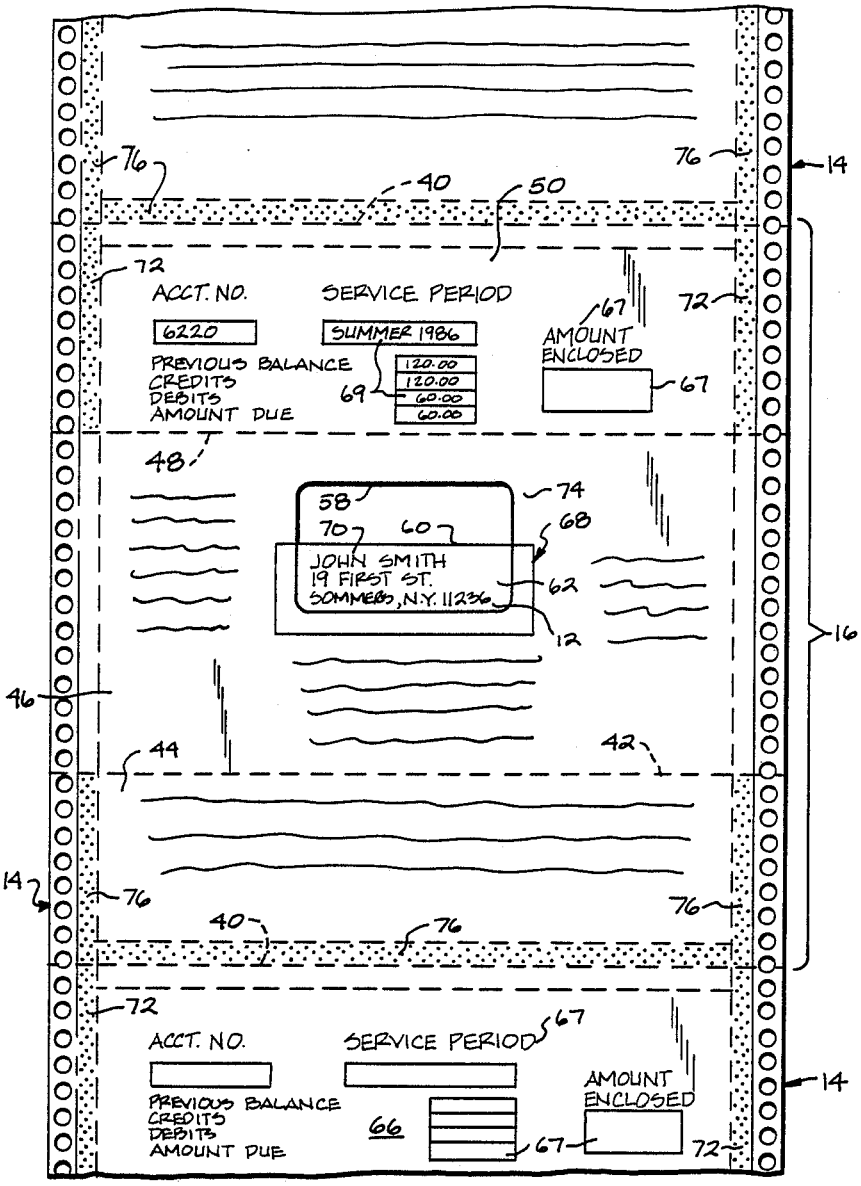
FIG. 2 is a fragmentary plan view of the inner face thereof at a stage part way through a variable printing step.
Figure 4:
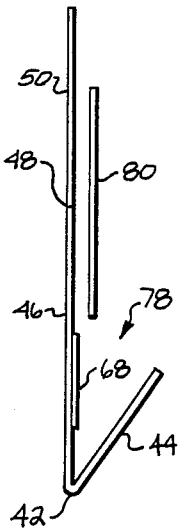
FIG. 4 is a side elevation view showing assembly of an insert to a single specimen of the mailer after up-folding of the head panel of the mailer.

Turning now to FIG. 2, FIG. 2 shows the opposite, inner face 66 of the form stock 10 shown in FIG. 1, but at a somewhat later stage, in which the form stock is being variably printed on the inner face 66, e.g. by a business or other institutional user of the form stock 10. It should be noted that the heading orientation of the form stock 10 in FIG. 2 is opposite to that shown in FIG. 1 (so that the illustrated printing shows in a right-side-up condition).

As part of the form stock manufacturing process, the window flap of each form has been opened by folding it inwards along its perforation line 60 after adhering to its inner face 66 a patch of paper or the like 68, which extends laterally and longitudinally a short distance, e.g. one-quarter of an inch, beyond the die cut line 58. Thus, at this stage, the outer face 12 of the window flap 62 is displayed flatwise on the inner face 66 of the form stock 10 as if it were part of that inner face.

The partial form shown lowermost in FIG. 2 is illustrated as it might look prior to having variable information printed thereon. Thus, it contains fields of preprinting 67 that were applied by the form stock manufacturer. The full form shown centrally in FIG. 2 has already passed through a variable printing station (not shown), in which a conventional computeroperated variable printer, which may be of an impact or non-heat generating, non-impact type, has applied fields of variable information 69, 70. The variable information 69 may all be on one of the panels, or it may be on any two or all three of the panels of each potential form 14. The field of variable information 70 is applied on the outer face 12 of the window flap 62, and will in most cases be constituted by the name and postal address of an intended recipient optionally together with one or more lines of coding relating to sort names, postal class, account number, subscription expiration date, delivery route number or the like.

The inner face 66 of the head panel 50 of each potential form 14 is shown provided on both its end tear strips with respective bands 72 of activatable, deactivated adhesive, e.g. heat-activated adhesive extending longitudinally between the respective imaginary fold line 48 and the respective transverse perforation line 40.

The inner face 66 of the middle panel 46 of each potential form 14 is shown provided perimetrically of the die cut line 58 with a narrow band 74 of activatable, deactivated adhesive, e.g. heat-activated adhesive, which is sized, shaped and positioned to later secure the window flap in a closed position by adhering with the protruding three-sided perimetrical margin of the patch 68.

The inner face of the foot panel 44 of each potential form 14 is shown provided with a generally squared-C-shaped band 76 of activatable, deactivated adhesive, e.g. heat-activated adhesive which extends in an inverted arch from the transverse fold line 42, down a respective end tear strip, across the width of the potential form adjacent the respective bottom edge-defining perforation line 40 and up the opposite end tear strip to the same transverse fold/perforation line 42. All these bands of adhesive preferably are applied by the form stock manufacturer, using conventional techniques and materials, as the form stock is being manufactured. Some or all of the bands of adhesive may be applied as patterns of dots of adhesive, rather than as solid stripes, and care should be taken, as it conventionally is, to slightly space applications of adhesive away from perforation lines in order to reduce the prospect for bleed-through of adhesive.

Figure 5:
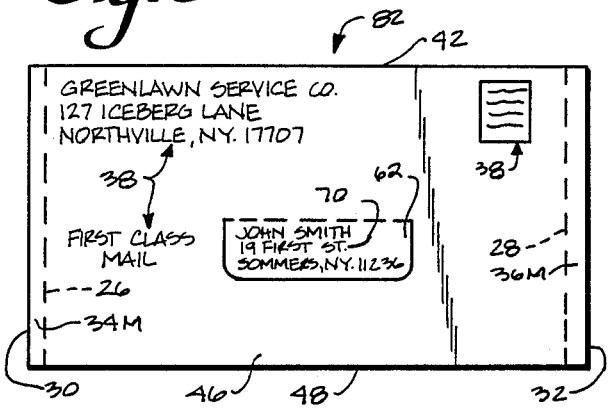
FIG. 5 is a plan view of the front of the mailer.
Figure 3:
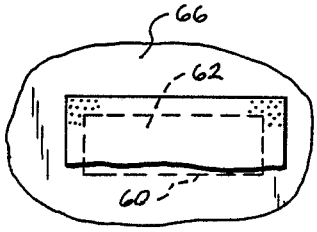
FIG. 3 is a fragmentary detail plan view of the FIG. 2 web at a later stage showing the flap window in a closed and fastened condition.

After the inner face 66 of each successive potential form 14 of the web 10 (including the folded-in outer face 12 of its window flap 62) is variably printed, the window flap 62 is folded back in order to close the window (as illustrated in FIGS. 3 and 5). The laterally outer portions 34L, 36L of the marginal strips 34, 36 may now be cut off from the web 10 along the imaginary lines 30, 32, the rows of sprocket holes having served their purpose in permitting reliable guiding of the forms to this stage. Further, the web 10 is burst into individual forms 14, by severing along the successive transverse perforation lines 40. These steps may be performed using conventional slitting and form-bursting apparatus.

At further stages, the head panel 44 of each form is folded in to create a V-pocket 78, into which is deposited an insert body 80. The insert body 80 may be a single sheet, a folded sheet, a stack of sheets, a return envelope, or the like. Its length and width dimensions may be nearly equal to the internal dimensions of the pocket of the closed and sealed mailer in which it is to be contained.

Figure 6:
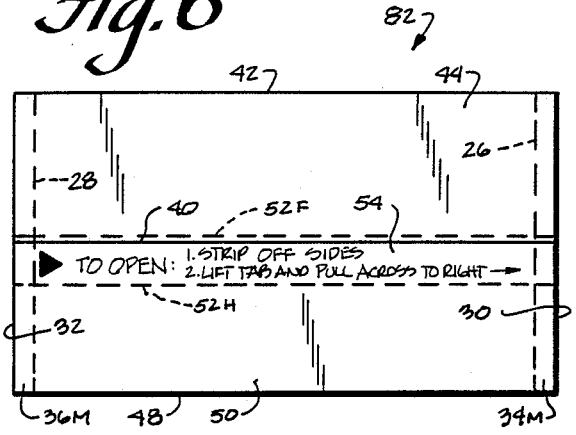
FIG. 6 is a plan view of the rear thereof.

After the insert body 80 has been deposited in the V-pocket 78, the foot panel of the form is folded in along the transverse fold/perforation line 48, and the resulting assembly is passed between heated platens to activate the bands of adhesive thus completely sealing the mailer closed as a confidentiality-preserving wrapper of the insert body, as well as for preserving the confidentiality of the communication contained in the combination of relatively non-varying and variably printed information on the inner face 66 of the form 14. In this condition, depicted in FIGS. 5 and 6, the mailer 82 of the invention may be mailed or otherwise transferred or delivered e.g. to an intended recipient.

The recipient opens the mailer 82 by tearing off the end tear strips 34M, 36M along the perforation lines 26, 28, and pulling across the transverse tear strip 54, whereupon the remainder of the mailer sheet 14 may be unfolded and the insert body obtained.

Typically, information provided on the inner face of the mailer, and/or on the insert body informs the recipient of actions which are to be taken in use of the form materials by him or her, e.g. to sever part of the remainder of the mailer sheet 14 to use as a remittance stub, or as a check or receipt, to return part of the remainder of the mailer sheet in the return envelope of the insert body, or in another envelope, and the like. To facilitate compliance, the web 10 may be further provided by the form stock manufacturer with respective fields of printed instructions, and with further perforation lines or cut-indication lines to be used by the recipient in subdividing the remainder of the mailer sheet 14 into two or more separate pieces, e.g. one to keep and another to send back.

In a presently preferred practice of the invention, each potential form 14 is 11.0 inches long, the middle panel of the form is 5.375 inches deep, the transverse fold/perforation line 48 is spaced 3.125 inches from the closest inter-form perforation line 40, and the foot panel overlaps the head panel by 0.375 inch on the back of the mailer, the foot panel being 2.5 inches deep (all of these exemplary dimensions being approximate). The transverse pull strip 54 preferably is about 0.375 inch in depth, and preferably includes especially weakened slits or perforations at its leading end in order to facilitate the initiation of tearing it off. However, the web 10 at perforation lines 52H and 2F should have a greater tensile strength than at the perforation lines 40, e.g. 9–12 pounds per linear inch, versus 5–8 pounds per linear inch, so that as the forms are successively detached from the web, they detach at 40, without severing the other perforation lines. This differential strength may be accomplished by known means, including making the perforation lines 52H, 52F of larger, coarser perforations than the perforation lines 40.

It should now be apparent that the bifolded mailer with insert as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A bifolded mailer with insert, comprising:

a paper sheet having left and right edges, said paper sheet beiing folded twice in the same direction to provide a middle panel adjoining a head panel and a foot panel along respective transverse fold lines;

said head panel having a top edge which is lapped with a bottom edge of said foot panel intermediate the depth of said middle panel;

means securing said head panel to said foot panel marginally of said top and bottom edges, and means securing said paper sheet to itself, panel to panel marginally of said left and right edges in order to define a substantially completely enclosed pocket;

an insert body, separate from said paper sheet, contained within said enclosed pocket;

left and right end tear strip means defined on said paper sheet and adapted to permit respective left and right edge marginal portions to be severed from said paper sheet along the full depth of said paper sheet; and transverse tear strip means cooperatingly defined in both said head and foot panels and extending from one to the other of said left and right edge marginal portions, so that after said left and right marginal portions have been severed from said paper sheet and said transverse tear strip means has been torn across said paper sheet, the resulting bifolded remainder of said paper sheet may be opened up for viewing of an inner face thereof and for gaining access to said insert body, said transverse tear strip means comprising two longitudinally spaced transverse perforation lines in said paper sheet including one provided in said head panel adjacent but longitudinally spaced from said top edge of said head panel and another provided in said foot panel adjacent but longitudinally spaced from said bottom edge of said foot panel.

2. The bifolded mailer with insert of claim 1, wherein:

said left and right tear strip means include longitudinal perforation lines running the full depth of said paper sheet adjacent but transversally spaced from respective left and right edges of said paper sheet.

3. The bifolded mailer with insert of claim 1 wherein:

one of said panels contains a window flap adapted to bear on one face thereof a variably printed recipient name and address.

4. The bifolded mailer with insert of claim 3, further including:

securement means maintaining said window flap in a closed condition, said one face being an outer face of said window flap.

5. The bifolded mailer with insert of claim 4, wherein:

said panel containing said window flap is said middle panel.

6. The bifolded mailer with insert of claim 5, wherein:

said securement means maintaining said window flap in a closed condition comprises a patch secured to an inner face of said window flap, and to said paper sheet adjacent said window flap.

7. The bifolded mailer with insert of claim 5, wherein:

at least one of said panels, on an inner face thereof, contains a printed form adapted to bear variably printed informaion relating to an account of said recipient.

8. The bifolded mailer with insert of claim 1, wherein:

one of said panels contains a window flap adapted to bear on one face thereof a variably printed recipient name and address.

9. The bifolded mailer with insert of claim 8, further including:

securement means maintaining said window flap in a closed condition, said one face being an outer face of said window flap.

10. The bifolded mailer with insert of claim 9, wherein:

said panel containing said window flap is said middle panel.

11. The bifolded mailer with insert of claim 10, wherein:

said securement means maintaining said window flap in a closed condition comprises a patch secured to an inner face of said window flap, and to said paper sheet adjacent said window flap.

12. The bifolded mailer with insert of claim 10, wherein:

at least one of said panels, on an inner face thereof, contains a printed form adapted to bear variably printed information relating to an account of said recipient.

13. The bifolded mailer with insert of claim 1, wherein:

said insert body is at least one paper sheet.

14. The bifolded mailer with insert of claim 1, wherein:

said insert body includes a return envelope.

15. A form stock for providing a plurality of bifolded mailers, said form stock comprising:

a paper web of indeterminate length, having left and right edges, an inner face and an outer face;

means defining a series of transverse line locations spaced longitudinally of the sheet to provide sites at which said paper web may be successively severed into a respective plurality of individual paper sheets, each thereby having a top edge and a bottom edge;

said paper web, between each adjacent two of said transverse line locations having means defining two longitudinally spaced transverse fold line locations along which each said paper sheet may be folded to provide a middle panel adjoining a head panel and a foot panel, on which the respective said top edge is lapped with the respective said bottom edge intermediate the depth of the respective said middle panel;

means on said paper web for securing said head panel of each said paper sheet to said foot panel of the same said paper sheet marginally of the respective said top and bottom edges, and means for securing each said paper sheet to itself, panel to panel, marginally of said left and right edges in order to define for each said paper sheet a respective substantially completely enclosed pocket;

left and right end tear strip means defined in said paper web and adapted to permit respective left and right edge marginal portions to be severed from each said paper sheet along the full depth of such paper sheet; and transverse tear strip means for each said paper sheet, this transverse tear strip means being cooperatively defined in both said head panel and said foot panel for each said paper sheet and extending from one to the other of said left and right edge marginal portions, so that after said left and right marginal portions have been severed from each said paper sheet, and the respective said tear strip means has been torn across each said paper sheet, the resulting bifolded remainder of each said paper sheet may be opened up for viewing said inner face thereof, said transverse tear strip means for each said paper sheet comprising two longitudinally spaced transverse perforation lines in the respective said paper sheet including one provided in said head panel thereof adjacent but longitudinally spaced from said top edge of said head panel and another provided in said foot panel thereof adjacent but longitudinally spaced from said bottom edge of said foot panel.

16. The form stock of claim 15, wherein:

said left and right tear strip means include longitudinal perforation lines running the full depth of said paper web adjacent but transversally spaced from respective left and right edges of said paper web.

17. The form stock of claim 15, wherein:

for each said paper sheet, one of said panels contains a window flap adapted to bear on one face thereof a variably printed recipient name and address.

18. The form stock or claim 17, further including:

for each said window flap, deactivated, activatable securement means for maintaining said window flap in a closed condition, said one face being an outer face of said window flap.

19. The form stock of claim 18, wherein:

for each said window flap, said panel containing such window flap is a middle panel.

20. The form stock of claim 19, wherein:

for each said window flap, said securement means comprises a patch secured to an inner face of that window flap, and deactivated, activatable adhesive means for adhering that flap to the respective said paper sheet adjacent said flap.

21. The form stock of claim 19, wherein:

for each said paper sheet, said paper web, on at least one of said panels, on said inner face, contains a printed form adapted to receive variably printed information relating to an account of the respective said recipient.

22. The form stock of claim 15, wherein:

for each said paper sheet, one of said panels contains a window flap adapted to bear on one face thereof a variably printed recipient name and address.

23. The form stock of claim 22, further including:

for each said window flap, deactivated, activatable securement means for maintaining said window flap in a closed condition, said one face being an outer face of said window flap.

24. The form stock of claim 23, wherein:

for each said window flap, said panel containing such window flap is a middle panel.

25. The form stock of claim 24, wherein:

for each said window flap, said securement means comprises a patch secured to an inner face of that window flap, and deactivated, activatable adhesive means for adhering that flap to the respective said paper sheet adjacent said flap.

26. The form stock of claim 24, wherein:

for each said paper sheet, said paper web, on at least one of said panels, on said inner face, contains a printed form adapted to receive variably printed information relating to an account of the respective said recipient.

* * * * *